US007171873B2

(12) United States Patent
Horvath

(10) Patent No.: US 7,171,873 B2
(45) Date of Patent: Feb. 6, 2007

(54) TENSIONLESS POWER RATCHET WRENCH ASSEMBLY

(75) Inventor: John Horvath, Cuyahoga Falls, OH (US)

(73) Assignee: NMTC, Inc., Stow, OH (US)

( * ) Notice: Subject to any disclaimer, the term of this patent is extended or adjusted under 35 U.S.C. 154(b) by 39 days.

(21) Appl. No.: 11/423,189

(22) Filed: Jun. 9, 2006

(65) Prior Publication Data

US 2006/0248986 A1 Nov. 9, 2006

Related U.S. Application Data

(63) Continuation of application No. 11/161,366, filed on Aug. 1, 2005, now Pat. No. 7,059,217, which is a continuation of application No. 10/666,383, filed on Sep. 19, 2003, now Pat. No. 6,923,095.

(51) Int. Cl.
*B25B 13/46* (2006.01)
*B25B 17/00* (2006.01)

(52) U.S. Cl. ..... 81/57.39; 81/57; 81/58

(58) Field of Classification Search ..... 81/57.39, 81/57, 58, 60, 61, 62, 63.1, 57.3
See application file for complete search history.

(56) References Cited

U.S. PATENT DOCUMENTS

| | | | | |
|---|---|---|---|---|
| 2,232,477 A | | 2/1941 | Rueb | |
| 4,346,630 A | * | 8/1982 | Hanson | 81/57.13 |
| 4,722,252 A | * | 2/1988 | Fulcher et al. | 81/57.39 |
| 4,802,387 A | | 2/1989 | Williams, III | |
| 4,987,802 A | * | 1/1991 | Chern | 81/57.39 |
| 4,987,803 A | | 1/1991 | Chern | |
| 5,090,237 A | | 2/1992 | Schrumpf et al. | |
| 5,105,688 A | * | 4/1992 | Williams, III | 74/810.1 |
| 5,231,901 A | | 8/1993 | Putney et al. | |
| 5,537,899 A | * | 7/1996 | Diedrich | 81/57.39 |
| 5,782,147 A | | 7/1998 | Chaconas et al. | |
| 5,967,002 A | * | 10/1999 | Pijanowski | 81/57.39 |
| 5,983,757 A | | 11/1999 | Blise et al. | |
| 6,070,499 A | | 6/2000 | Wisbey | |
| 6,138,532 A | | 10/2000 | McCann | |
| 6,189,419 B1 | | 2/2001 | Pijanowski | |
| 6,209,422 B1 | | 4/2001 | Kamiya et al. | |
| 6,263,768 B1 | | 7/2001 | Huang et al. | |
| 6,481,316 B1 | | 11/2002 | Liao | |
| 6,490,953 B2 | | 12/2002 | Horvath | |
| 6,516,930 B2 | | 2/2003 | Chen | |
| 6,568,298 B1 | | 5/2003 | Zinck | |
| 6,923,095 B2 | | 8/2005 | Horvath | |
| 7,059,217 B2 | | 6/2006 | Horvath | |

* cited by examiner

*Primary Examiner*—Lee D. Wilson
*Assistant Examiner*—Alvin J Grant
(74) *Attorney, Agent, or Firm*—Hahn Loeser & Parks, LLP; Robert J. Clark

(57) ABSTRACT

A power ratchet wrench assembly having a tensionless head wherein operation of the ratchet mechanism does not require a tensioning means for applying a frictional force against the ratchet mechanism to inhibit rotational movement of the ratchet mechanism. In one embodiment, the invention provides a first gear, a second gear, and a ratchet mechanism having a drive body; wherein the drive body is alternately: coupled to the first gear and ratcheting with the second gear, and coupled to the second gear and ratcheting with the first gear.

20 Claims, 5 Drawing Sheets

TENSIONLESS POWER RATCHET WRENCH ASSEMBLY

This application is a continuation of U.S. patent application Ser. No. 11/161,366, filed Aug. 1, 2005, now U.S. Pat. No. 7,059,217 which is a continuation of U.S. patent application Ser. No. 10/666,383, filed Sep. 19, 2003, now issued as U.S. Pat. No. 6,923,095, both hereby incorporated by reference.

FIELD OF THE INVENTION

The present invention relates to a power ratchet wrench assembly, and more specifically to a power ratchet wrench assembly having a tensionless head wherein operation of the ratchet mechanism does not require a tensioning means for applying a frictional force against the ratchet mechanism to inhibit rotational movement of the ratchet mechanism.

BACKGROUND OF THE INVENTION

Power ratchet wrenches which are held in the hand and are driven by a motor are commercially known in the art. Such ratchet wrenches typically embody a handle part and a head portion, wherein the head portion has a pair of ears extending therefrom which house a reciprocating yoke and a ratchet mechanism housed within the yoke. A drive motor is positioned in the handle to drive the reciprocating yoke. Typically these drive motors have been pneumatic, however other motors have also been utilized as well. In pneumatic power ratchet wrench types, the end of handle portion contains a compressed air inlet port which connects to a compressed air supply by various means known in the art. An actuation button or lever is located between air inlet port and housing, which allows the operator to actuate the pneumatic motor, the drive mechanism and ratchet mechanism.

Prior art power ratchet wrenches all require a tensioning means to hold the ratchet mechanism in position while the yoke is reciprocating back to an initial drive position, otherwise, the ratchet mechanism would reciprocate with the yoke. This frictional force is typically referred to as head tension or simply tension. Tension is typically provided by a spring such as a wave spring or Bellville washer which biases the ratchet mechanism against one of the ears of the head or a bushing attached to the ears of the head. Other prior art devices utilize springs which bias a ball against one of the ears of the head or a bushing attached to the ears of the head. A problem with these prior art power ratchets is that this frictional force must be overcome when the yoke is driving the ratchet mechanism, thus reducing the efficiency of the ratchet. Another problem with these prior art power ratchets is that when torque is applied to the ratchet head, the ears of the ratchet head begin to widen apart or spread. Upon repeated application of torque to ratchet head, the ears may remain in a spread position. This causes ratchet mechanism to function improperly because the ears no longer hold the tensioning means in a compressed state and the resulting loss of tension allows the ratchet mechanism to reciprocate with the yoke.

This is a significant problem in prior art ratchet head designs and increases the costs to maintain these ratchet wrenches for both the end user/owner and the ratchet wrench manufacturers. Therefore, there is a need for an improved ratchet head design which maintains proper operation of the ratchet mechanism of the power ratchet wrench by overcoming at least one of the problems identified in the prior art power ratchet wrenches.

SUMMARY OF THE INVENTION

The present invention provides a power ratchet wrench assembly comprising: a handle portion; a head portion adjacent the handle portion, the head portion comprising a head body; an actuator positioned on one of the handle portion and the head portion, the actuator selectively engaging a drive motor housed in the handle portion; a yoke member comprising a recess and a first gear; a crank rotatably driven by the motor, the crank having a drive bushing which engages the recess of the yoke and causes the yoke to reciprocate when the crank is rotated by the motor; a second gear; a ratchet mechanism having a drive body, wherein the drive body is alternately: coupled to the first gear and ratcheting with the second gear, and coupled to the second gear and ratcheting with the first gear.

At least one advantage over the prior art is also by provided by a power ratchet wrench assembly comprising: a handle portion; a head portion adjacent the handle; an actuator positioned on one of the handle portion and the head portion, the actuator selectively engaging a drive motor housed in the handle portion; a yoke comprising a recess and an internal gear positioned at least partially within the head portion; a crank driven by the motor in a rotational direction, the crank having a drive bushing which engages the recess of the yoke and causes the yoke to reciprocate when the crank is driven by the motor; a ratchet mechanism positioned at least partially within the internal gear of the yoke; wherein the operation of the ratchet mechanism does not require a tensioning means for applying a frictional force against the ratchet mechanism to inhibit rotational movement of the ratchet mechanism.

At least one advantage over the prior art is also by provided by a power ratchet wrench assembly comprising: a handle portion; a head portion adjacent the handle portion; an actuator positioned on one of the handle portion and the head portion, the actuator selectively engaging a drive motor housed in the handle portion; a yoke comprising a recess and a first internal gear, the yoke positioned within the head portion; a crank driven by the motor in a single rotational direction, the crank having a drive bushing which engages the recess of the yoke and causes the yoke to reciprocate when the crank is driven by the motor; a drive body positioned at least partially within the yoke and the head portion; a first ratcheting means for mechanically locking the drive body to the internal gear of the yoke to enable rotation of the drive body in a predetermined rotational direction; and a second ratcheting means for mechanically locking the drive body in a fixed position to prevent rotation of the drive body counter to the predetermined rotational direction.

At least one advantage over the prior art is also by provided by a power ratchet wrench assembly comprising: a handle portion; a head portion adjacent the handle, the head portion comprising a head body, an actuator positioned on one of the handle portion and the head portion, the actuator selectively engaging a drive motor housed in the handle portion; a first gear; a crank member driven by the motor in a single rotational direction and causing the first gear to reciprocate; a second gear; a drive body; a first pawl pivotally attached to the drive body having teeth on at least one end thereof disposed for engagement with the teeth of the first gear; and a second pawl pivotally attached to the drive body having teeth on at least one end thereof disposed for engagement with the teeth of the second gear; wherein the drive body is coupled to and rotates with the first gear by engagement of the first pawl when the first gear is rotated in a first rotational direction; and wherein the drive body rotates with respect to the second gear by the ratcheting of the second pawl when the first gear is rotated in the first rotational direction.

DETAILED DESCRIPTION OF THE DRAWINGS

Reference will now be made in detail to various embodiments of the present invention, examples of which are illustrated in the accompanying drawings. Whenever possible, the same reference numbers will be used throughout the drawings to refer to the same or like parts.

Figure 1:
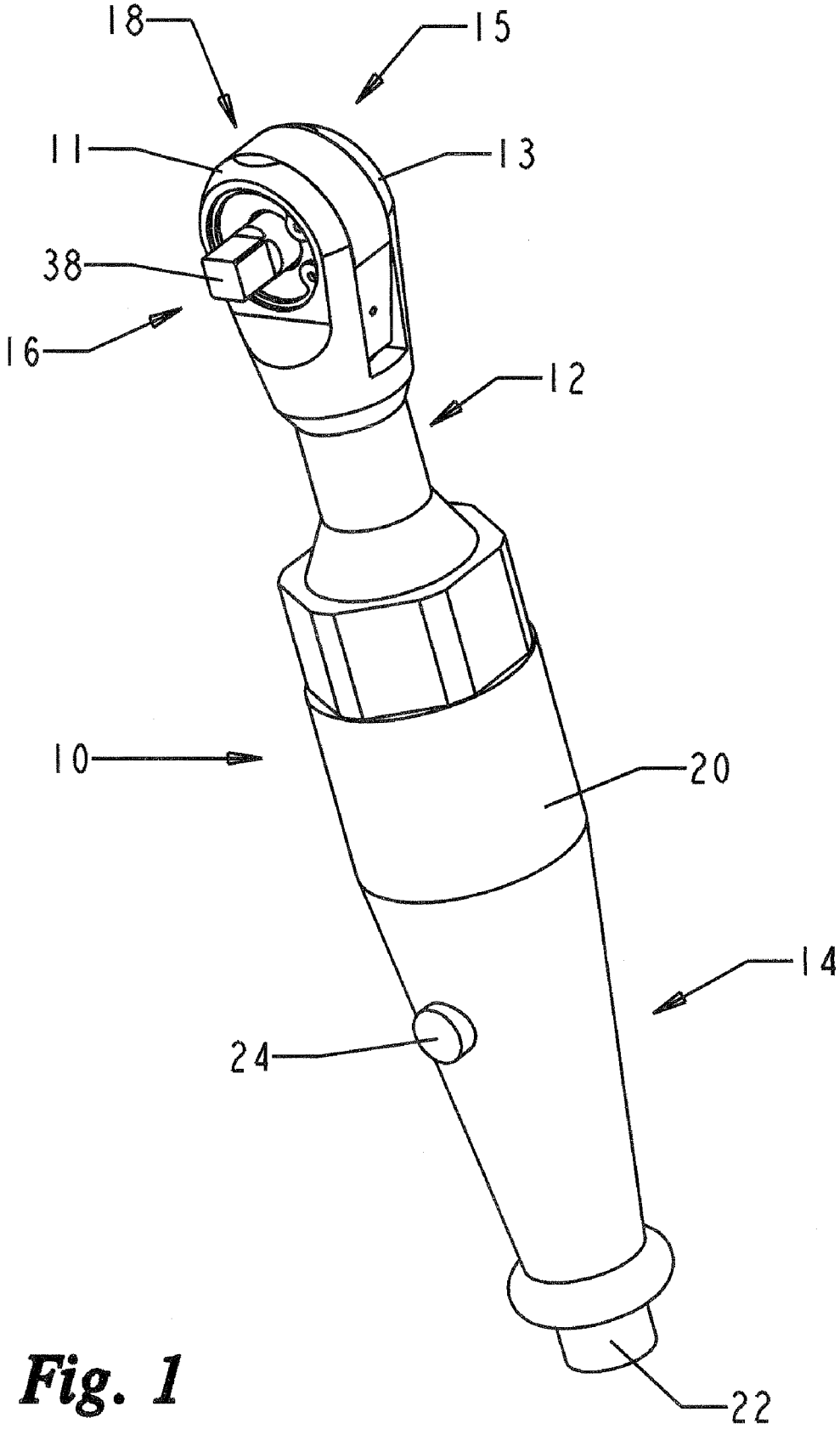
FIG. 1 is a perspective view of a first embodiment of the power ratchet assembly of the present invention.

Referring now to FIG. 1, the first embodiment of the power ratchet wrench assembly of the present invention is shown at 10 having a head portion 12 adjacent a handle portion 14. The head portion 12 and handle portion 14 may be manufactured as a single piece or made as separate pieces attached to each other. Head portion 12 comprises a head body 15 in which a yoke 18 is inserted. The head body 15 may be of any known configuration including a clam shell, flat, and dual ear configurations. For graphical purposes only and without limiting the scope of the present invention, the head body 15 shown in FIG. 1 is of the dual ear type having a first ear 11 and a second ear 13. Bores are formed within ears 11 and 13 to allow for placement of a ratchet mechanism 16 as described herein. Handle portion 14 includes a housing 20 which encloses a drive motor, not shown. Although a pneumatic drive motor is described as the power source and is well known in the art, other motors such as electric motors can be used to drive the ratchet wrench assembly of the present invention. The end of handle portion 14 has an air inlet port 22 for connection to a compressed air supply by various means known in the art. An actuator 24 is positioned generally near the air inlet port 22 which allows the operator to actuate the pneumatic motor, the drive mechanism, and the ratchet mechanism 16. This actuator 24 may be a button as shown, a lever, or any other type of throttle valve activating device known and used in the art.

Figure 2:
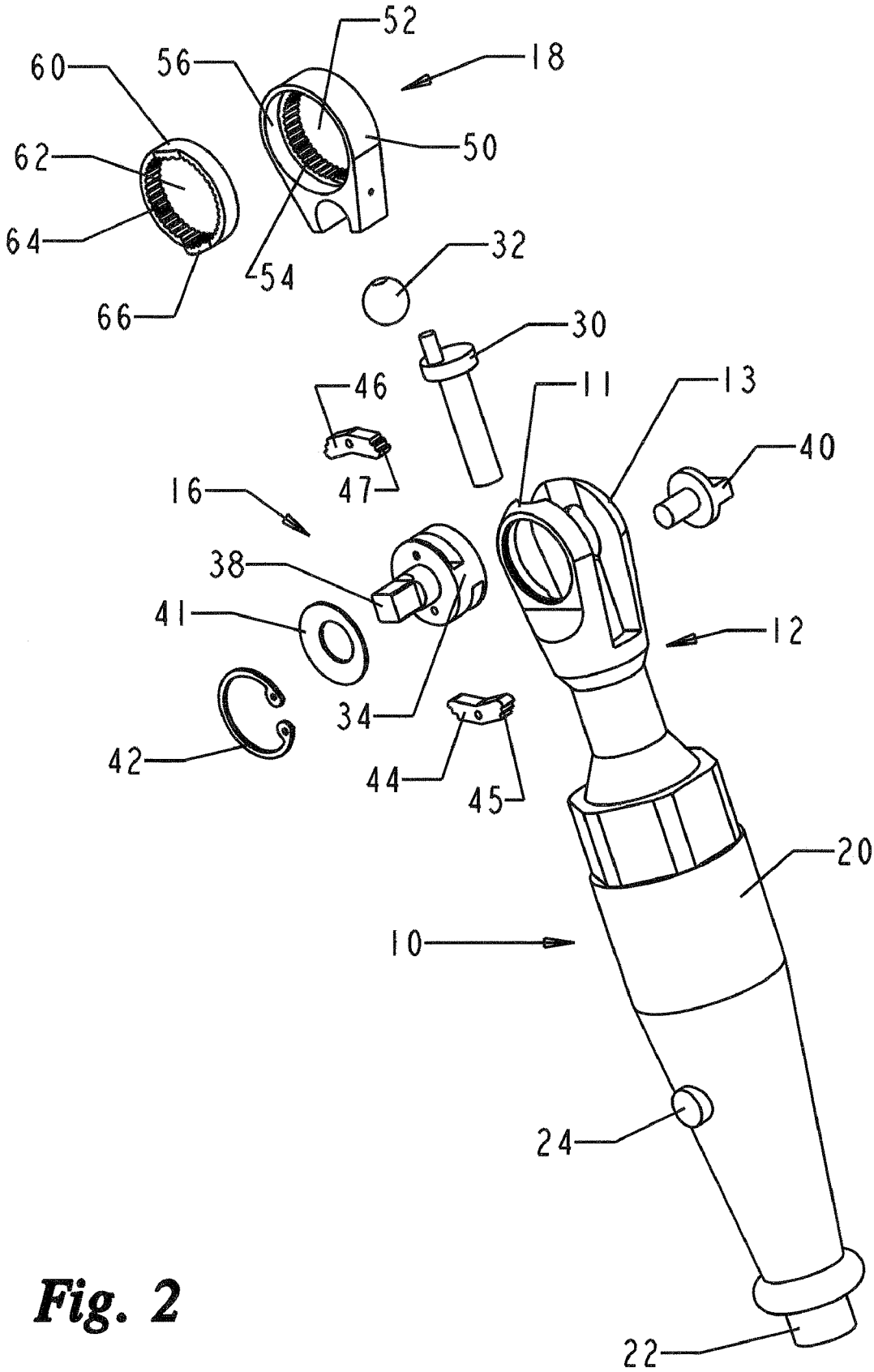
FIG. 2 is an exploded perspective view of the first embodiment of the power ratchet assembly of FIG. 1.

Referring now to FIG. 2, the power ratchet wrench assembly 10 is shown in an exploded view. The power ratchet wrench assembly 10 comprises a crank 30 and a drive bushing 32 which fits within head portion 12, when assembled. Drive bushing 32 fits within a recess formed in yoke 18. Crank 30 is rotated by a pneumatic motor (not shown), which in turn causes drive bushing 32 to revolve and yoke 18 to reciprocate, when assembled. The ratchet mechanism 16 comprises a ratchet drive body 34 including drive square 38, at least one pawl 44, 46, and a shift lever 40. Shift lever 40 allows for selection of the direction of rotation of drive body 34, drive square 38, and any socket affixed to the drive square 38. Ratchet mechanism 16 is positioned at least partially within yoke 18 to allow for rotation of drive body 34. Ratchet mechanism 16 is retained on one side by the second ear 13 and on the other side by a thrust washer 41 which is retained to the first ear 11 by a snap ring 42, or the like.

Yoke 18 comprises a first gear member 50 shown as an internal gear having a bore 52 formed therein and teeth 54 formed along the circumference of the bore 52, and a second gear member 60, shown as an internal gear having a bore 62 formed therein and teeth 64 formed along the circumference of the bore 62. The first gear member 50 has a recess 56 formed in the bore 52 at a predetermined depth to allow the second gear member 60 to be inserted into the recess 56. Second gear member 60 comprises a tang 66, key or other appropriate device which cooperates with the adjacent ear 11 such that the second gear member 60 is fixed and does not move with respect to the head 12. The pawls comprise pawl 44 having teeth 45 on at least one end thereof disposed for engagement with the teeth 54 of the first gear member 50 and a second pawl 46 having teeth 47 on at least one end thereof disposed for engagement with the teeth 64 of the second gear member 60.

In operation, the drive motor (not shown) causes the crank 30 and attached drive bushing 32 to rotate. The drive bushing 32 engages the first gear member 50 and causes it to rotate in a first or predetermined drive direction. The first gear member 50 is coupled to the ratchet mechanism 16 by the engagement of the teeth 45 of pawl 44 with the teeth 54 of the first gear member 50, causing rotation of the drive body 34 and drive square 38. In the first drive direction, the teeth 47 of the second pawl 46 do not engage the teeth 64 of the second gear member 60, rather teeth 47 ratchet over teeth 64 which allows rotation of the ratchet mechanism 16 by the first gear member 50. Continued rotation of the drive bushing 32 will eventually cause the first gear member 50 to move back in a second drive direction. This change in direction causes the teeth 45 of first pawl 44 to disengage from, and ratchet over, the teeth 54 of first gear member 50, effectively uncoupling ratchet mechanism 16 from first gear member 50, and causes teeth 47 on the second pawl 46 to engage the teeth 64 of the second gear member 60. Therefore, ratchet mechanism 16 is locked into position with respect to the head 12, while the first gear member 50 rotates in the second direction. Continued rotation of crank 30 causes this cycle to repeat resulting in rotation of drive square 38 in the desired direction only.

Accordingly, due to the alternating engagement and disengagement of the pawls 44, 46 with a reciprocating gear 50 and a fixed gear 60, no means for tension or friction is required for operation of the power ratchet assembly of the present invention. As previously mentioned, prior art power ratchets all utilize a spring or other biasing means to apply friction to the ratchet mechanism such that the friction allows the ratchet mechanism to stay in position relative to the head while the yoke is ratcheting in the second direction. This friction associated with prior art power ratchets must be overcome in the driving direction which significantly reduces the efficiency of the tool. The present invention provides a tensionless rotation which allows the maximization of the tool efficiency.

Figure 3:
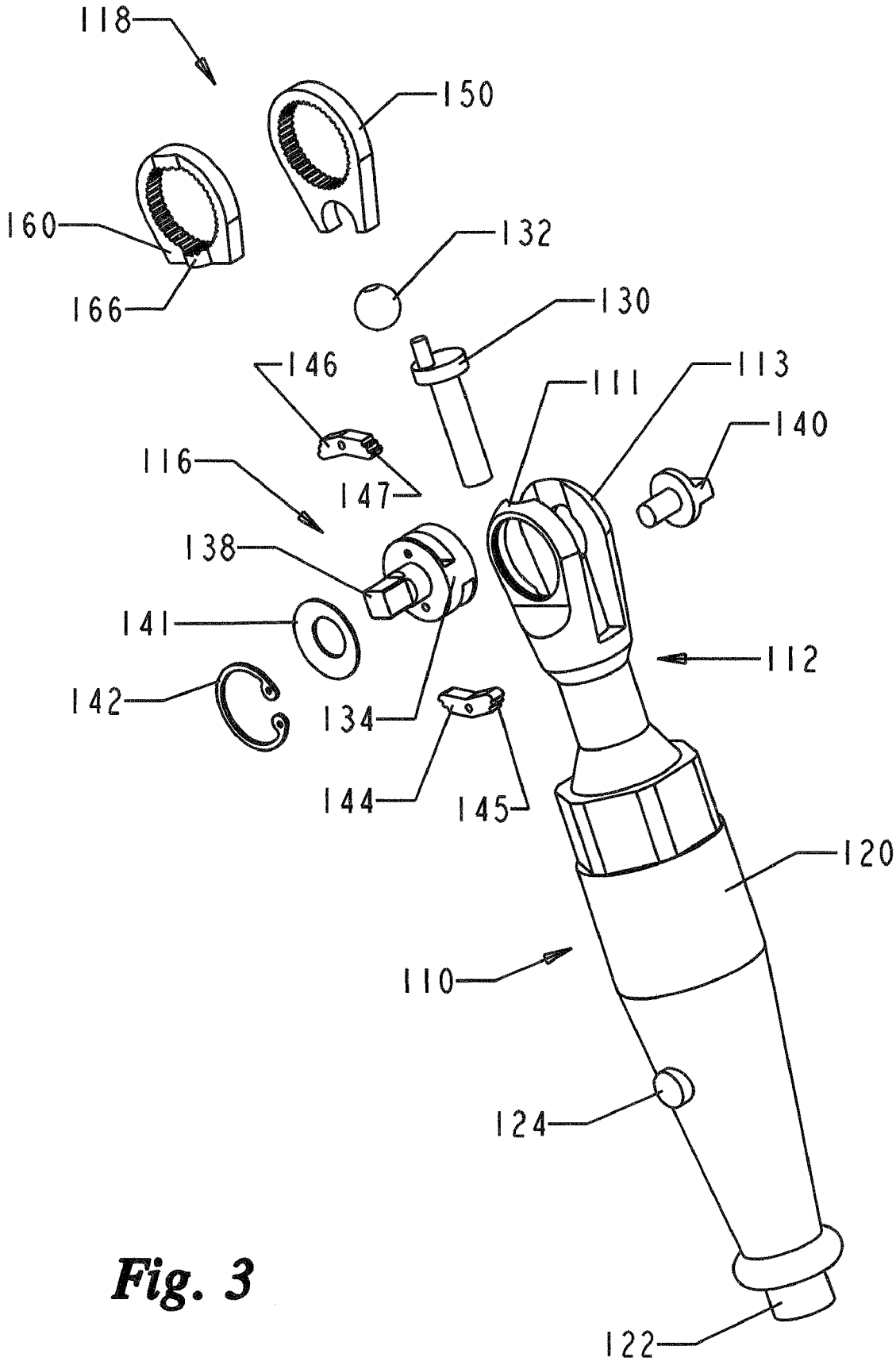
FIG. 3 is an exploded perspective view of a second embodiment of the power ratchet assembly of the present invention.

Referring now to FIG. 3, a second embodiment of the power ratchet assembly 110 of the present invention is shown in an exploded view wherein the yoke 118 comprises a first gear member 150 and a second gear member 160 generally formed as an annular ring positioned adjacent the first gear member 150. As with the previous embodiment, the first gear member 150 has a neck portion with an aperture therein which is engaged by the drive bushing 132. In contrast to the previous embodiment, the second gear member 160 is not positioned in a recess, but rather is positioned adjacent to the first gear member 150. It is noted that the width of the second gear member 160 may be significantly less than the width of the first gear member 150 as the force required by the second gear member 160 to mechanically lock the drive body 134 to the head 112 is minimal when compared to the torque applied by the first gear member 150 to the drive body 134. It is also noted that the second gear member 160 is coupled to the head by a tang 166 or the like and that the second gear member 160 does not engage the drive bushing 132. Although not shown, the neck portion of the first gear member 150 may be the full width between the ears 111, 113 of the head 112 to promote full contact with drive bushing 132, if needed. The present embodiment of ratchet assembly 110 allows for simple production and retro-fit capabilities with current production assemblies by allowing the second gear member 160 to be cut from existing prior art yokes.

Figure 4:
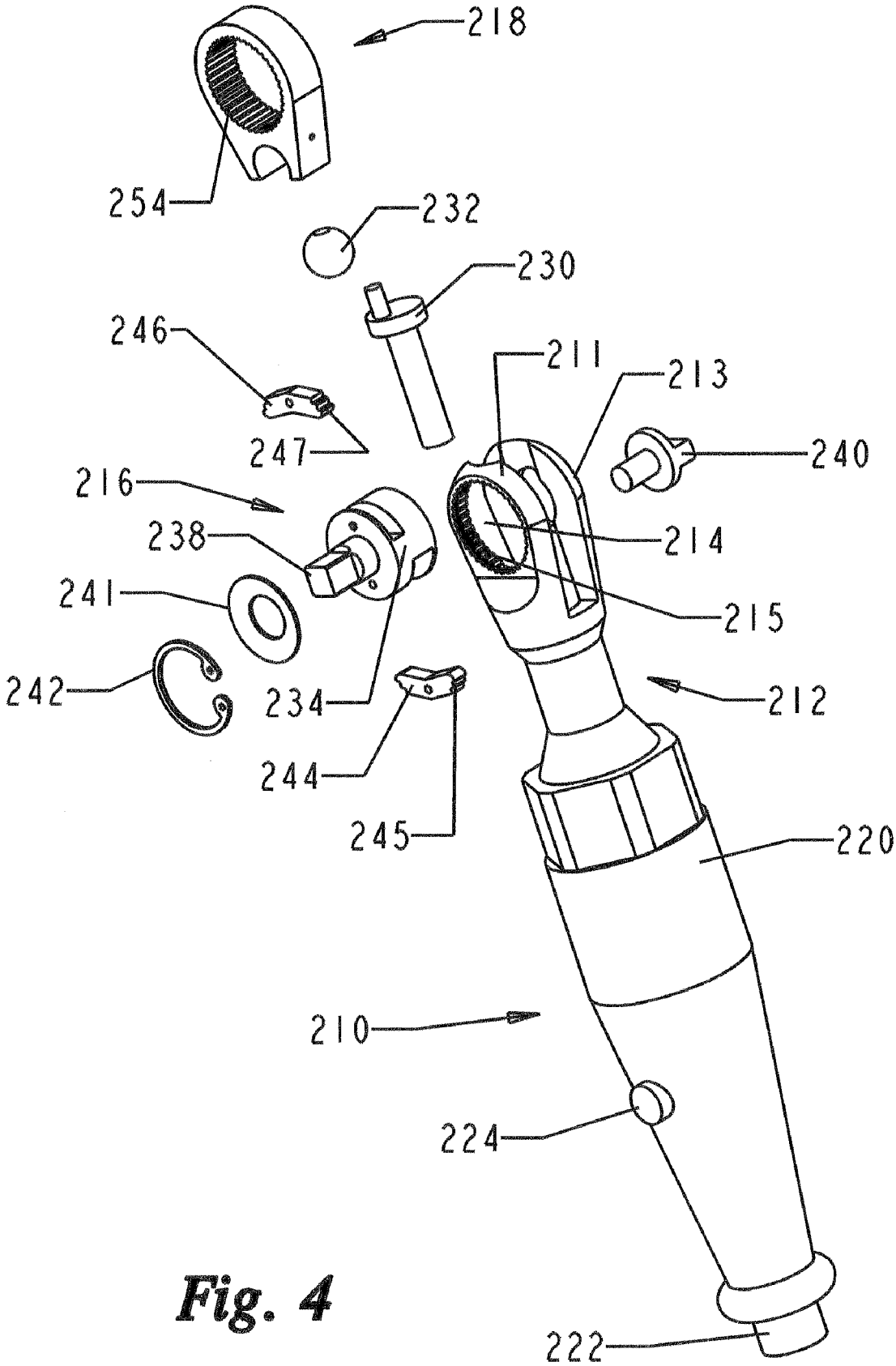
FIG. 4 is an exploded perspective view of a third embodiment of the power ratchet assembly of the present invention.

Referring now to FIG. 4, a third embodiment of the power ratchet assembly 210 of the present invention is shown in an exploded view wherein the yoke 218 is formed as a standard prior art yoke. A portion of the bore 214 of the first ear 211 of the ratchet assembly 210 is formed having teeth 215 formed along the circumference of the bore 214. The ratchet mechanism 216 comprises a first pawl 244 having teeth 245 on at least one end thereof disposed for engagement with the teeth 254 of the yoke 218 and a second pawl 246 having teeth 247 on at least one end thereof disposed for engagement with the teeth 215 of the first ear 211. It is also contemplated that the teeth 215 may be formed on a separate internal gear member positioned in a recess in the ear 211 of the head 212 and coupled to the head 212 by an interference fit, set screw, key, tang, or other mechanical means. This will allow easy replacement of the teeth 215 if they should become damaged or worn. Operation of the power ratchet assembly is generally the same as that of previous embodiments, except that the second gear is a portion of the ear 211. One advantage of the present embodiment is that a full width yoke is used such that the torque limit is maximized by the configuration of ratchet assembly 210.

Figure 5:
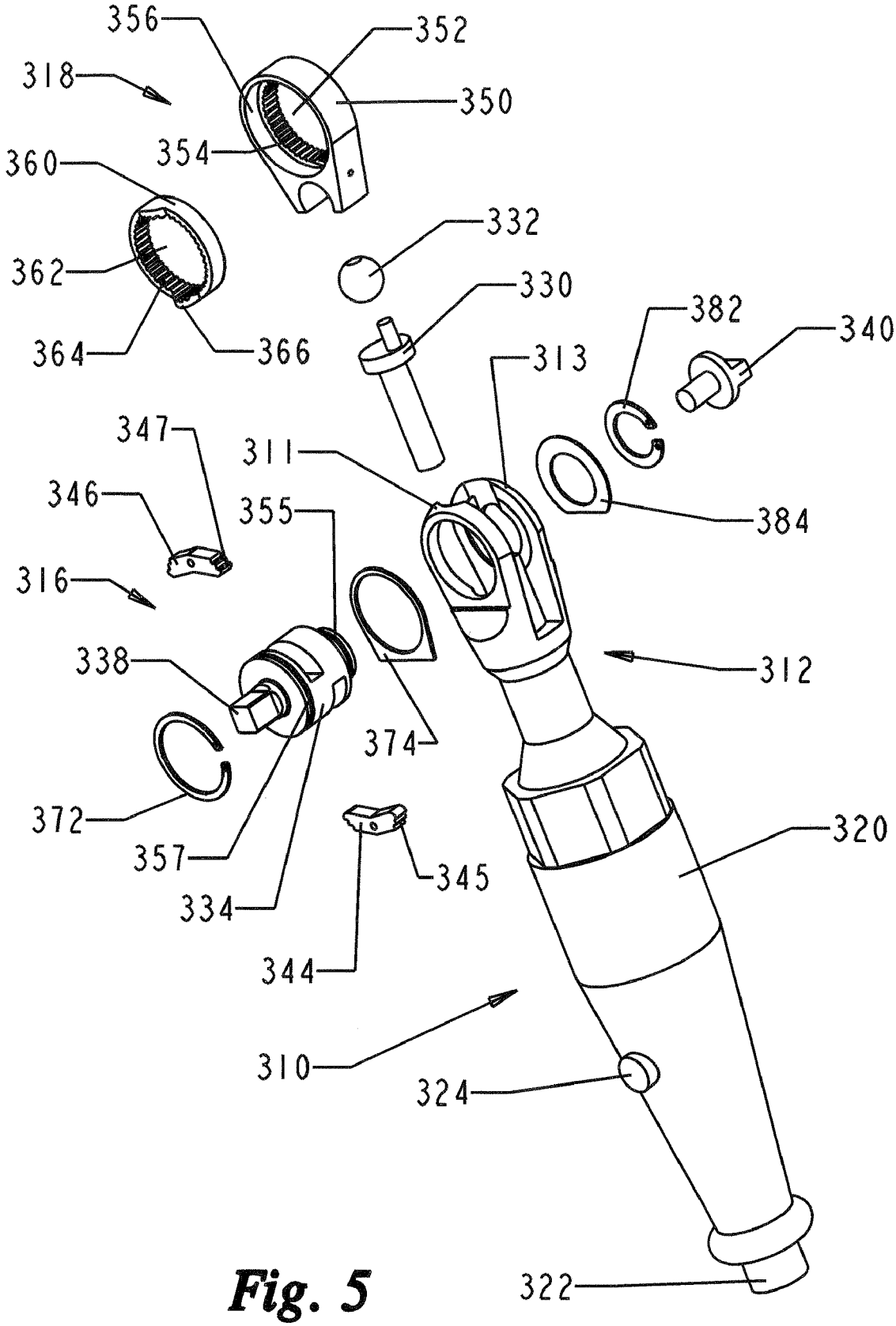
FIG. 5 is an exploded perspective view of another embodiment of the power ratchet assembly of the present invention.

Referring to FIG. 5, another embodiment of the power ratchet assembly 310 of the present invention is shown having an externally captured ratchet head. Although the present invention does not rely on tension means for operation, spreading of the ears of the ratchet head may still present a problem. At the minimum, the spread ears make the ratchet assembly aesthetically unpleasing. Severe spreading of the head ears could possibly affect operation by allowing misalignment of the gears and associated pawls. Externally capturing the head provides an added feature which enhances the durability and operation of the tool. Externally captured ratchet heads are disclosed in U.S. Pat. No. 6,490,953, and herein incorporated by reference. Power ratchet assembly 310 of FIG. 5 is shown identical to the embodiment shown in FIGS. 1 and 2, except that ratchet assembly 310 comprises means for attaching the ratchet mechanism 316 to the head portion 312, wherein the means are positioned external to the head portion 312. The head portion 312 of power ratchet wrench assembly 310 comprises a first ear 311 and a second ear 313. The means for attaching the ratchet mechanism 316 to the head portion 312 comprises a first mechanical fastener 372 engaging the ratchet mechanism 316 external to the first ear 311 and a second mechanical fastener 382 engaging the ratchet mechanism 316 external to the second ear 313. Ratchet mechanism 316 comprises a drive body 334 having grooves 355 and 357 on either end thereof, the ratchet mechanism 316 positioned through yoke 318. Mechanical means 372, 382 such as snap rings or other suitable fasteners are positioned exterior to ears 311, and 313 and engage grooves 357 and 355, respectively, to secure the ratchet assembly 316 to the head portion 312 and capture yoke 318 between the ears 311, 313. It is also contemplated that wear surfaces or washers 374 and 384 can be provided along the primary wear surfaces of the ratchet wrench head portion 312, and thus prevent head portion 312 from becoming worn. Wear washer 384 is placed on the outer surface of ear 313 and wear washer 374 is placed on the outer surface of ear 311. The wear surfaces 374, 384 are secured in place by snap rings 372 and 382 affixed within grooves 357 and 355, respectively, completing assembly of the ratchet head. Because snap rings 372 and 382 are positioned externally, ears 311 and 313 are prevented from spreading upon the application of torque to head portion 312. Wear washers 374 and 384 are replaced as necessary to prevent damage to head portion 312.

As shown in FIGS. 1 through 5, yoke 18, and elements thereof in the various embodiments of the present invention may be provided with a lubrication port for application of lubricants, such as grease for example, to the area of engagement between the teeth formed on the inner surface of yoke and or yoke members, and the teeth formed on the ends of the pawl(s) of the ratchet mechanism. Further, lubrication port may be provided with more than one outlet, with one of these outlets allowing for the application of lubricants to the drive mechanism, i.e. the ball and crank, of the powered ratchet wrench.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention. For example, variations of the present invention may include spur gears having external teeth and corresponding pawls. Accordingly, the scope and content of the present invention are to be defined only by the terms of the appended claims.

What is claimed is:

1. A power ratchet wrench assembly comprising:

a handle portion;

a head portion adjacent the handle portion, the head portion comprising a head body, an actuator positioned on one of the handle portion and the head portion, the actuator selectively engaging a drive motor housed in the handle portion;

a yoke member comprising a recess and a first gear;

a crank rotatably driven by the motor, the crank having a drive bushing which engages the recess of the yoke and causes the yoke to reciprocate when the crank is rotated by the motor;

a second gear;

a ratchet mechanism having a drive body, wherein the drive body is alternately:

coupled to the first gear and ratcheting with the second gear, and coupled to the second gear and ratcheting with the first gear.

2. The power ratchet wrench assembly of claim 1, wherein the second gear is coupled to the head body.

3. The power ratchet wrench assembly of claim 1, wherein the ratchet mechanism comprises:

a first pawl pivotally attached to the drive body having teeth on at least one end thereof disposed for engagement with the first gear; and a second pawl pivotally attached to the drive body having teeth on at least one end thereof disposed for engagement with the second gear.

4. A power ratchet wrench assembly comprising:

a handle portion;

a head portion adjacent the handle portion, an actuator positioned on one of the handle portion and the head portion, the actuator selectively engaging a drive motor housed in the handle portion;

a yoke comprising a recess and a first internal gear, the yoke positioned within the head portion, a crank driven by the motor in a rotational direction, the crank having a drive bushing which engages the recess of the yoke and causes the yoke to reciprocate when the crank is driven by the motor;

a drive body positioned at least partially within the yoke and the head portion, a first ratcheting means for mechanically locking the drive body to the internal gear of the yoke to enable rotation of the drive body in a predetermined rotational direction, and a second ratcheting means for mechanically locking the drive body in a fixed position to prevent rotation of the drive body counter to the predetermined rotational direction.

5. The power ratchet wrench assembly of claim 4, wherein the first ratcheting means comprises a first pawl pivotally attached to the drive body having teeth on at least one end thereof disposed for engagement with the internal gear of the yoke.

6. The power ratchet wrench assembly of claim 4, wherein the second ratcheting means comprises a second internal gear coupled to the head portion and a second pawl pivotally attached to the drive body having teeth on at least one end thereof disposed for engagement with the second internal gear.

7. A power ratchet wrench assembly comprising:

a handle portion;

a head portion adjacent the handle, an actuator positioned on one of the handle portion and the head portion, the actuator selectively engaging a drive motor housed in the handle portion;

a yoke comprising a recess and an internal gear positioned at least partially within the head portion, a crank driven by the motor, the crank having a drive bushing which engages the recess of the yoke and causes the yoke to reciprocate when the crank is driven by the motor;

a ratchet mechanism positioned at least partially within the internal gear of the yoke;

wherein the operation of the ratchet mechanism does not require a tensioning means for applying a frictional force against the ratchet mechanism to inhibit rotational movement of the ratchet mechanism.

8. The power ratchet wrench assembly of claim 7, wherein the yoke comprises a first internal gear member and a second internal gear member.

9. The power ratchet wrench assembly of claim 8, wherein the second internal gear member is coupled to the head portion.

10. The power ratchet wrench assembly of claim 8, wherein the ratchet mechanism comprises a rotatable drive body and a first and a second pawl pivotally mounted thereon, the first pawl having teeth on at least one end thereof disposed for engagement with the first internal gear member and the second pawl having teeth on at least one end thereof disposed for engagement with the second internal gear member.

11. The power ratchet wrench assembly of claim 10, wherein the drive body is coupled to and rotates with the first internal gear member by engagement of the first pawl when the first internal gear member is rotated in a first rotational direction and wherein the drive body rotates within the second internal gear member by the ratcheting of the second pawl when the first internal gear member is rotated in the first rotational direction.

12. The power ratchet wrench assembly of claim 11, wherein the drive body is coupled to the second internal gear member by engagement of the second pawl when the first internal gear member is rotated in a second rotational direction and wherein the drive body rotates within the first internal gear member by the ratcheting of the first pawl when the first internal gear member is rotated in a second rotational direction.

13. The power ratchet wrench assembly of claim 8, wherein the second internal gear member is formed as a sleeve housed within a recess of the first internal gear member.

14. The power ratchet wrench assembly of claim 8, wherein the second internal gear member is positioned adjacent the first internal gear member.

15. The power ratchet wrench assembly of claim 7, wherein the head portion comprises a first ear and a second ear, wherein the second ear comprises an internal gear.

16. The power ratchet wrench assembly of claim 15, wherein the ratchet mechanism comprises a rotatable drive body and a first and a second pawl pivotally mounted thereon, the first pawl having teeth on at least one end thereof disposed for engagement with the internal gear of the yoke and the second pawl having teeth on at least one end thereof disposed for engagement with the internal gear of the second ear.

17. The power ratchet wrench assembly of claim 16, wherein the drive body is alternately:

coupled to the yoke and ratcheting within the second ear, and coupled to the second ear and ratcheting within the yoke.

18. A power ratchet wrench assembly comprising:

a handle portion;

a head portion adjacent the handle, the head portion comprising a head body, an actuator positioned on one of the handle portion and the head portion, the actuator selectively engaging a drive motor housed in the handle portion;

a first gear, a crank member driven by the motor in a single rotational direction and causing the first gear to reciprocate;

a second gear, a drive body, a first pawl pivotally attached to the drive body having teeth on at least one end thereof disposed for engagement with the teeth of the first gear; and a second pawl pivotally attached to the drive body having teeth on at least one end thereof disposed for engagement with the teeth of the second gear;

wherein the drive body is coupled to and rotates with the first gear by engagement of the first pawl when the first gear is rotated in a first rotational direction; and wherein the drive body rotates with respect to the second gear by the ratcheting of the second pawl when the first gear is rotated in the first rotational direction.

19. The power ratchet wrench assembly of claim 18, wherein the second gear is coupled to the head body.

20. The power ratchet wrench assembly of claim 18, wherein the drive body is coupled to the second gear by engagement of the second pawl when the first gear is rotated in a second rotational direction.

* * * * *